United States Patent [19]

Anfelt

[11] 4,084,265

[45] Apr. 18, 1978

[54] PROTECTIVE GLOVE

[75] Inventor: Bertil Anfelt, Stockholm, Sweden

[73] Assignee: Landstingens Inkopscentral, Lic, Ekonomisk Forening, Solna, Sweden

[21] Appl. No.: 707,256

[22] Filed: Jul. 21, 1976

[30] Foreign Application Priority Data

Jul. 31, 1975 Sweden ..... 7508686

[51] Int. Cl.[2] ..... A41D 19/00

[52] U.S. Cl. ..... 2/163; 2/167

[58] Field of Search ..... 2/16, 159, 161 R, 167, 2/169; 229/53, 69

[56] References Cited

U.S. PATENT DOCUMENTS

| | | | |
|---|---|---|---|
| 3,224,574 | 12/1965 | McConnell et al. | 229/53 X |
| 3,235,881 | 2/1966 | Chisholm | 2/167 |
| 3,600,716 | 8/1971 | Berry | 2/167 |
| 3,601,816 | 8/1971 | Pordes et al. | 2/167 |

FOREIGN PATENT DOCUMENTS

| | | | |
|---|---|---|---|
| 240,994 | 12/1960 | Australia | 2/167 |

*Primary Examiner*—Werner H. Schroeder
*Assistant Examiner*—Moshe I. Cohen
*Attorney, Agent, or Firm*—Cushman, Darby & Cushman

[57] ABSTRACT

A protective glove consists of two plastic films such as polyethylene welded at the periphery of the glove, whereat at least one of the films has protuberances on one side. At least one film having a thickness in the region of 0.01 to 1.0 mm is made with commonly separated impressions on one side for providing corresponding protuberances on its other side. Said protuberances are substantially evenly distributed over the entire surface of the film and lie at such a small distance from each other, preferably in the region of 0.5 to 2 mm, that the adhesion between the films is at least partially inhibited to facilitate the introduction of a hand into the glove.

1 Claim, 3 Drawing Figures

PROTECTIVE GLOVE

The present invention relates to a protective glove of the known kind consisting of two thin films of plastic such as polyethylene welded around the periphery of the glove, at least one of the films having protuberances on one side.

Plastic gloves are normally manufactured from completely smooth and flat plastic film. Since the problem here is two thin films lying tightly against each other before cutting out the gloves with a welding tool, the adhesion between the respective films will be comparatively severe in the finished glove, and it will often be difficult to place the hand in such a glove. Especially with regard to the finger portions of the glove it is often necessary to press rather hard to get the finger into the respective finger portion. The resistance which has to be overcome thereby is partly the adhesion force between the halves of the glove and partly the adhesion or friction which is obtained between the skin surface of the hand and the smooth plastic film. If moreover the hand is somewhat moist the resistance increases.

It is however already known through the U.S. Pat. No. 3,235,881 to provide the glove films with protuberances in the shape of a large number of parallel ridges which extend in one direction on one side of the film and in another direction on the other side of the film. The ridges are solid and are made as beads on the film. Fabrication is difficult to carry out with desired high production speed. The solid ridges cause increased material consumption and thereby increased material cost over that for smooth films. A certain thickness of the plastic film is required in forming the ridges, which can only be carried out with difficulty on films with a thickness of about 0.03 mm. Furthermore the ridges form continuous channels which are sealed off at either end by the weld at the periphery of the glove, and this counteracts desired circulation of air between the film and the surface of the hand.

The object of the present invention is to eliminate as far as possible the drawbacks with known gloves of this kind, at the same time enabling the film thickness to be kept small, e.g. about 0.03 mm.

This is achieved with a protective glove having, in accordance with the invention, the characteristics disclosed in the following patent claims.

According to the invention at least one of the films forming one half of the glove is provided with embossed impressions on its outside and corresponding nodule-like protuberances on its inside, the protuberances lying relatively closely to each other and being substantially evenly distributed over the whole film so that the film is given a finely textured quilt-like structure. This results in that the protuberances completely or partially inhibit the comparatively severe adhesion occurring in previously known gloves made from thin and smooth plastic film.

The impressions and corresponding protuberances can be obtained in a manner known per se by the film being taken between a pair of embossing rollers whereby the one has a comparatively soft and elastic surface and the other has projections for embossing the impressions in the film.

Suitably both the films used for the glove are made with said impressions on one side and corresponding protuberances on the other side. For reasons of manufacturing technology one of the films has said protuberances on its inside, while the other film has the impressions on the inside of the film and the protuberances on the outside. Such a glove has been found considerably easier to put on than the known plastic gloves with completely smooth and unbroken surfaces on the inside.

Alternatively one of the films used for the glove can be made according to the invention, while the other film can either be smooth on the inside or made according to the invention with small nodular protuberances on the inside.

A tested sample of a glove according to the invention consisted of two identically alike polyethylene films with a thickness of about 0.03 mm which were welded together. Both films were embossed with closely lying nodular protuberances having a distance between the peaks of the protuberances in the region of 0.5 to 1.5 mm. The height of the protuberances was in the region of 0.02 to 0.1 mm. The films were placed one upon the other so that one film had the protuberances on the inside and the other had them on the outside, relative to the glove. It was established in the first place that adhesion between the films of the glove was substantially lower than for gloves with completely smooth films, resulting in that it was considerably easier to put on the glove according to the invention.

As may be seen from the above, it is a question here of films with a small thickness in the area of 0.03 mm and with closely adjacent nodule-like small protuberances in the surface of the film. The finely textured surface is hardly noticeable to the touch, but optically differs quite clearly from smooth films. In spite of the smallness of the protuberances, they do cause the discussed favourable effects. The invention is thus based on the insight that with the protective gloves of the kind in question it is possible to achieve considerable advantages with these small protuberances and corresponding impressions, their shallow height or depth enabling a comparatively high speed between the embossing rollers simultaneously as they only cause insignificant elongation and accompanying weakening of the plastic material in the film.

It has however been found that the glove also has other advantages. The weld at the periphery of the glove formed a less sharp edge than in the known gloves. The weld became tighter, which could be noted by filling the glove with water.

The glove according to the invention furthermore withstood a larger amount of elongation without breaking.

A suitable embodiment of the invention according to the testing samples above is shown schematically on the attached drawings.

In the figures there is shown a plastic glove consisting of two halves 1 and 2, cut out by a welding technique from two plastic films of polyethylene having a thickness of about 0.03 mm and lying one on top of the other.

The halves are kept together by a welding seam 3 lying at the periphery of the glove in a known manner.

Figure 1:
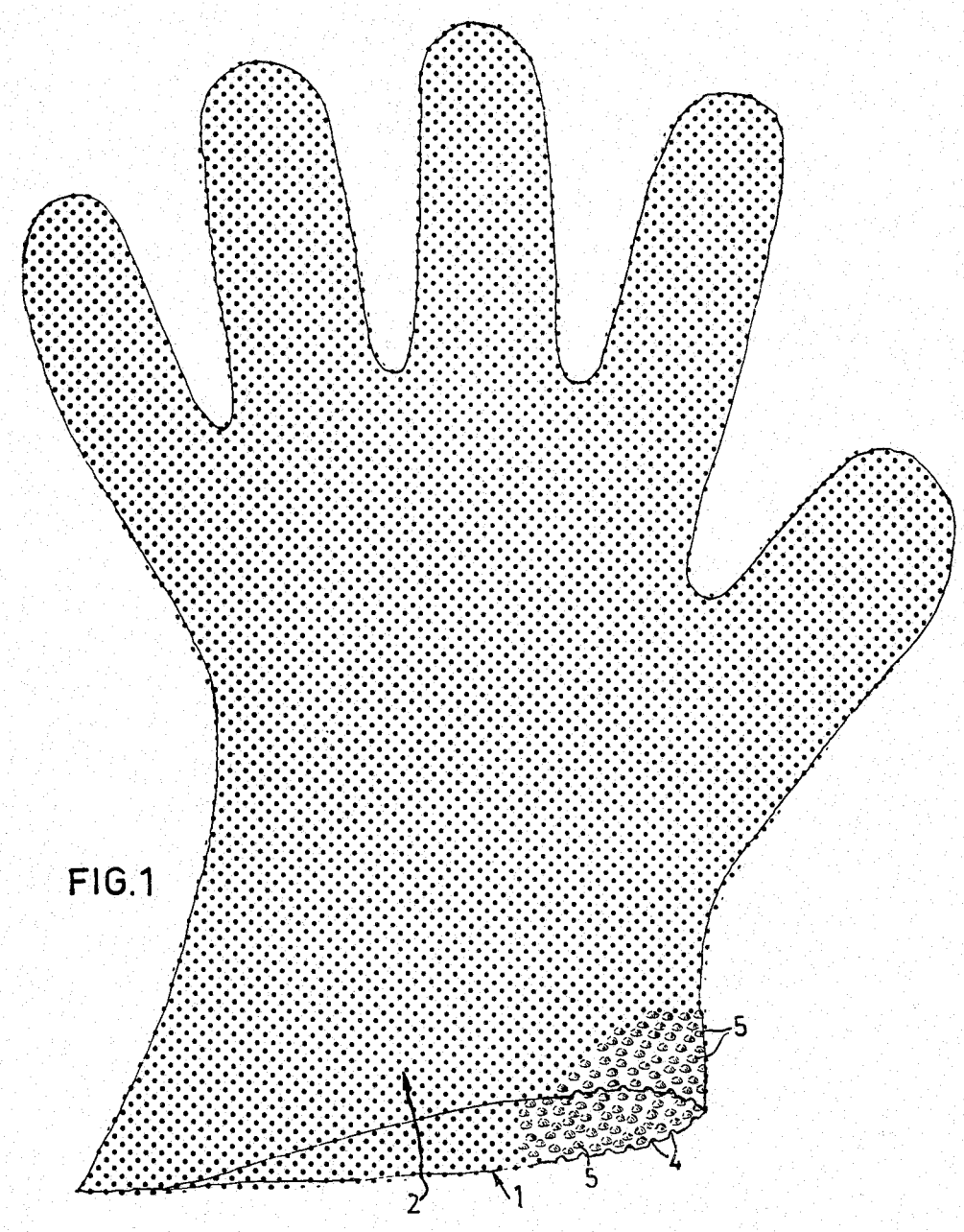
FIG. 1 is a plan view of one side of the glove according to the invention.
Figure 2:
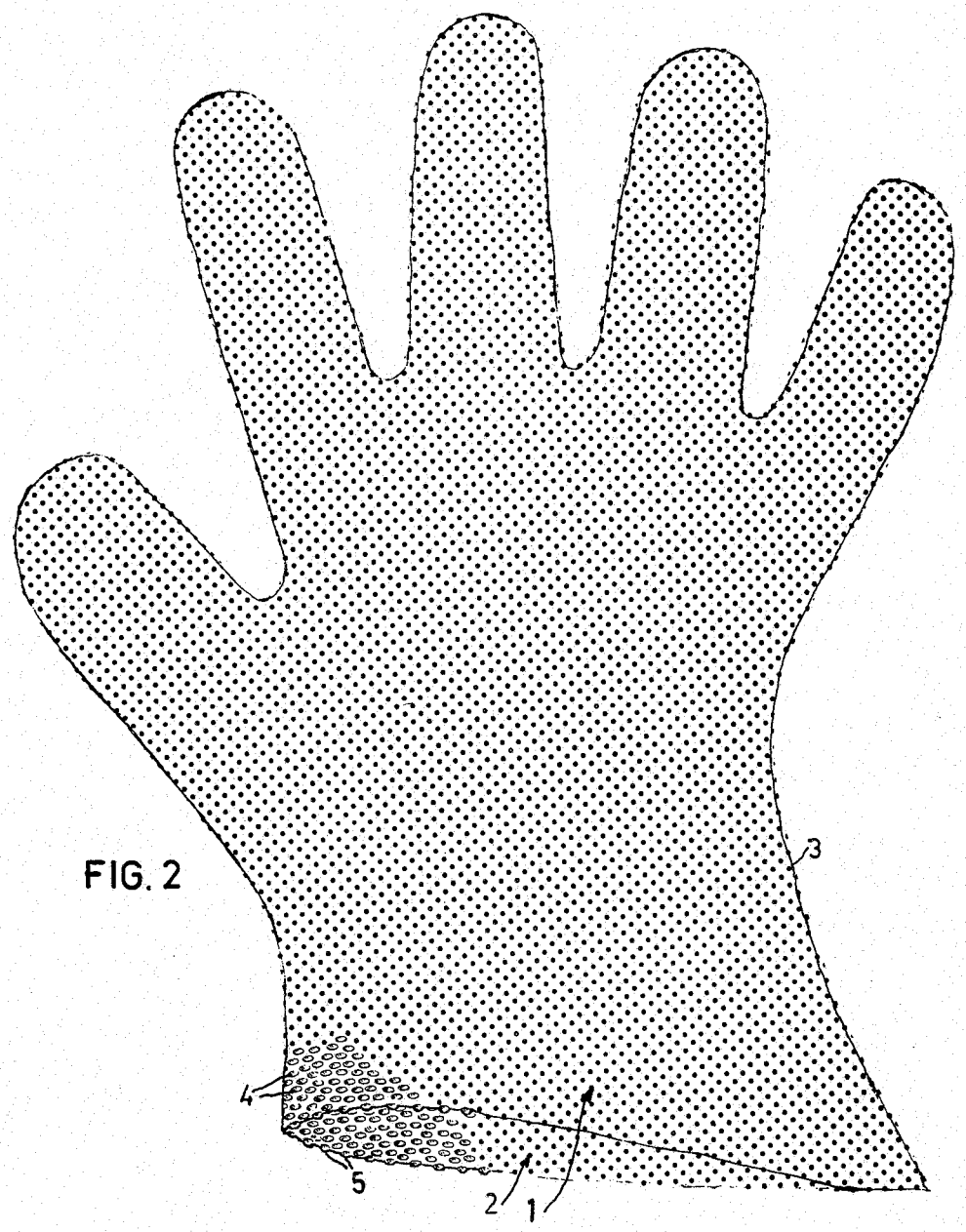
FIG. 2 is a plan view of the other side of the glove, in both figures there being shown a large number of evenly distributed points which indicate the approximate position of the impressions and corresponding protuberances which are impressed into both films and which can have the schematically shown shape indicated at a limited portion at the open end of the glove.
Figure 3:
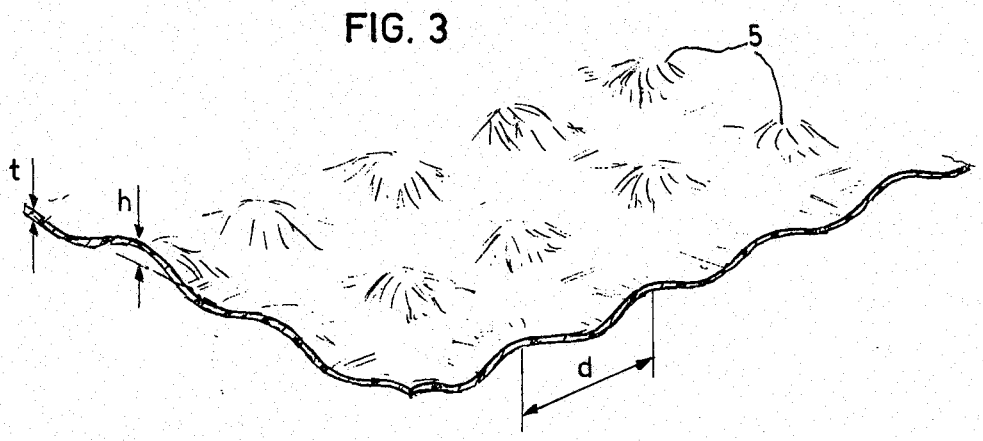
FIG. 3 is an enlarged perspective view of a section through one of the films of the glove and shows the position and shape of the protuberances.

Worked into both films there are impressions 4 on one side of the respective film with corresponding protuberances 5 on its opposite side. The respective impressions and protuberances suitably form a waffle-like surface structure as is shown in FIG. 3.

The size and distribution of the respective impressions and protuberances are as mentioned for the test sample discussed in the introduction, i.e., with a thickness $t$ in the region of 0.01 – 0.10 mm and a height $h$ for the protuberances in the region of 0.02 – 0.10 mm, with a distance $d$ between the centres of the protuberances in the region of 0.5 – 2.0 mm.

The film half 1 has the protuberances on its inside while the film half 2 has the impressions on its inside, relative to the glove.

In the glove now described and shown, one film half will thus have closely lying small nodular protuberances or impressions, the size and distribution of which is sufficient for reducing adhesion a desired amount between the films, and for achieving the remaining advantages mentioned above which have been attained with the test sample of a glove according to the invention.

Still another important advantage is that the evenly distributed impression will considerably increase the possibility of stretching the glove in all directions.

Gloves according to the invention may easily be manufactured as follows.

A plastic tube of polyethylene film having a thickness in the area 0.025 – 0.035 mm is blown upwardly and is separated at its opposite side edge to form two flat webs which are led between rollers, one roller having an elastic surface and the other having a multiplicity of evenly distributed, small projections which form corresponding embossed recesses in the two film webs. Thereafter the two webs are led substantially vertically to two rollers, one above the other, so that the projections or recesses on one web will be displaced relative to the projections or recesses on the other web in order not to lie opposite each other when the two webs are guided to lie flat on each other on a substantially horizontal welding table. Thereafter conventional welding and cutting tools are pressed against the two webs to obtain the plastic gloves in a manner known per se.

What I claim is:

1. A protective glove constructed of two overlying plastic films each having a thickness of 0.01 to 0.10 mm and both films having been deformed by embossing them simultaneously in overlying relationship so as to exhibit on one side a large number of embossed impressions each of which forms on the other side of the film a corresponding protuberance having a height of from 0.02 to 0.10 mm, said impressions and corresponding protuberances being substantially evenly distributed over the whole surface of the films and being spaced apart from 0.5 to 2 mm center-to-center, one of the films having its protuberances on the outside of the glove and the other film having its protuberances on the inside of the glove, and the protuberances on one film being displaced relative to the protuberances on the other film so that the protuberances do not lie opposite each other when the glove lies flat.

* * * * *